United States Patent [19]

Hight et al.

[11] 4,394,984

[45] Jul. 26, 1983

[54] ICE BLOCK LOADING MECHANISM FOR AN ICE SHAVING MACHINE

[75] Inventors: Rayburn M. Hight; Paul M. Corrick, both of Houston, Tex.

[73] Assignee: Polar Bear, Inc., Houston, Tex.

[21] Appl. No.: 222,545

[22] Filed: Jan. 5, 1981

[51] Int. Cl.[3] ..... B02C 13/286; B02C 18/22

[52] U.S. Cl. ..... 241/278 R; 241/280; 241/DIG. 17

[58] Field of Search ..... 241/DIG. 17, 280, 278 R, 241/273.2, 92

[56] References Cited

U.S. PATENT DOCUMENTS 380,844 4/1888 Bates et al. ..... 241/DIG. 17

487,339 12/1892 Webb ..... 241/DIG. 17

2,515,923 7/1950 Hansen ..... 241/280

*Primary Examiner*—Mark Rosenbaum

*Assistant Examiner*—Timothy V. Eley

*Attorney, Agent, or Firm*—Gunn, Lee & Jackson

[57] ABSTRACT

Apparatus for shaving ice from block of ice and producing selected quantities of finely divided ice particles for use in drinks, refreshments and the like. A power driven rotary shaving head incorporating ice shaving cutters is rotated against a block of ice to shave particles of ice therefrom. The ice block is moved against the shaving head by a pusher mechanism incorporating a wobble plate which grips a transverse guide and support rod under selective manual control. An externally positioned operator lever is manipulated by the user to induce precisely controlled movement of the ice pusher.

17 Claims, 9 Drawing Figures

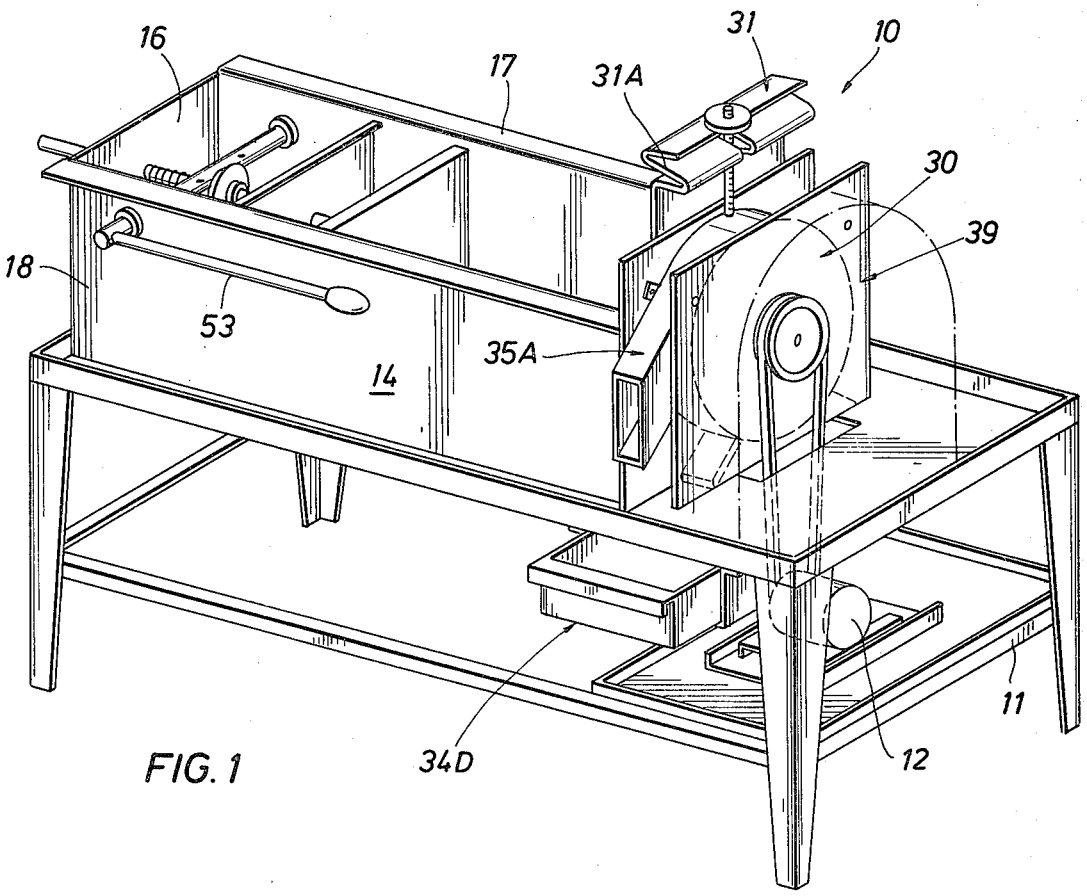
FIG. 1
FIG. 2
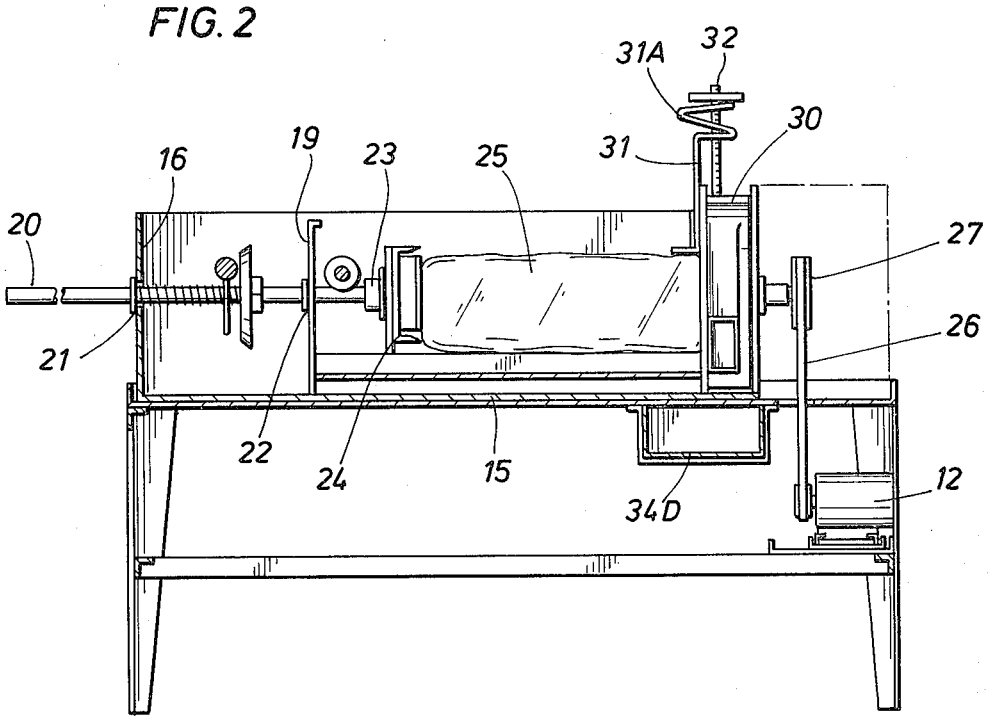

FIG. 6
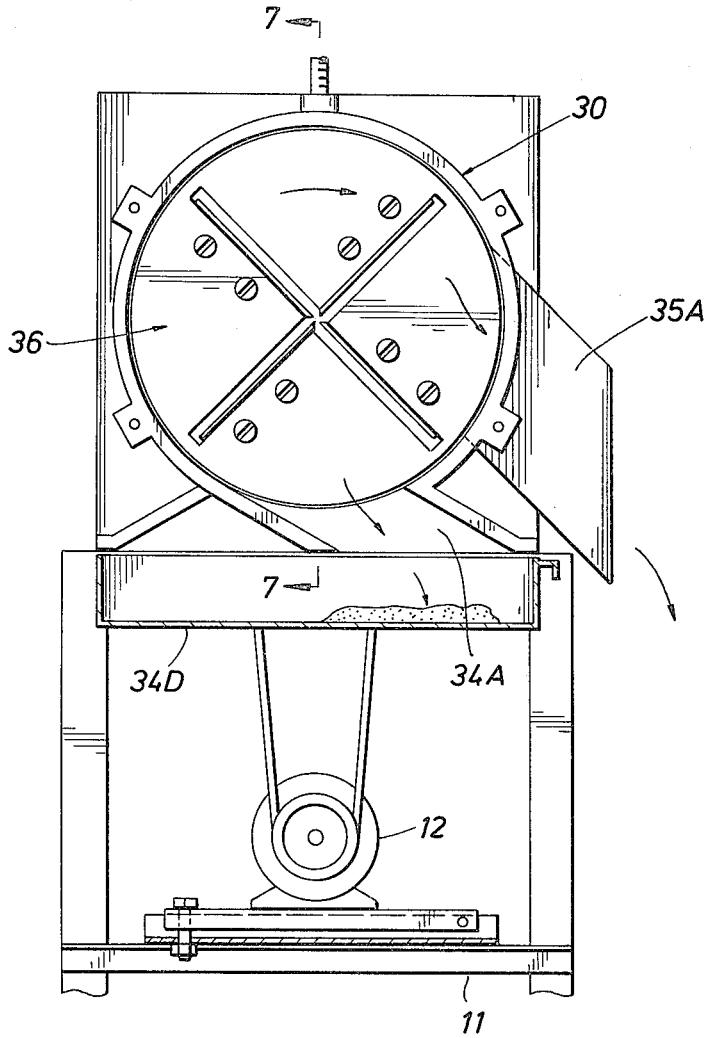
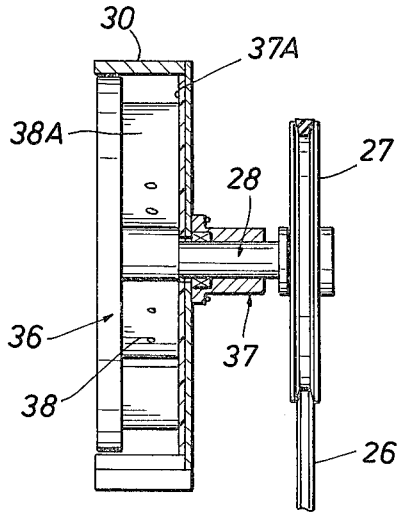
FIG. 7

ICE BLOCK LOADING MECHANISM FOR AN ICE SHAVING MACHINE

FIELD OF THE INVENTION

This invention relates generally to apparatus for shaving ice and more particularly is directed to an improved ice feeding and shaving mechanism that provides finely shaved ice of consistent quality.

BACKGROUND OF THE DISCLOSURE

Shaved ice is used in great quantities for various drinks or refreshments and has uses other than this too numerous to note. In the preparation of quantities of shaved ice, it is necessary to gradually feed a block of ice into a mechanized shaver mechanism. If gravity feed is used, it is generally erratic. Erratic ice feeding occurs because the ice block is initially quite heavy, and the mechanical jarring or vibration that occurs tends to break or otherwise defeat the feed mechanism. Where the block of ice is fed vertically, the shaved ice that results is of inconsistent quality. The absence of a smooth feeding procedure regrettably shaves the ice too fine, and, when a surge of force is applied to the block, the shavings are perhaps too coarse, and they tend to bind the shaver mechanism. Smooth ice shaving is achieved by application of smooth and steady feeding of an ice block against the ice shaving mechanism.

SUMMARY OF THE INVENTION

It is a principle feature of this invention to provide a novel ice shaving mechanism incorporating an ice feeding mechanism that provides for efficiently controlled application of mechanical force to a block of ice being shaved to ensure accurately controlled ice shaving which results in uniform quality of the resulting shaved ice.

It is another feature of this invention to provide a novel ice shaving mechanism employing an ice movement actuator which functions independently of the length of the ice block being moved to achieve shaved ice of uniform quality.

It is an even further feature of this invention to provide a novel ice shaving mechanism incorporating an ice block actuator for ice shaving machines which is of simple nature, is reliable in use and low in cost.

Other objects and features of this invention will become apparent to one skilled in the art upon consideration of this entire disclosure. The form of the invention, which will now be described in detail, illustrates the general principles of the invention, but it is to be understood that this detailed description is not to be taken as limiting the scope of the invention in any manner whatever.

In the present invention, a feed mechanism is disclosed which accommodates the block of ice from the maximum size obtained and which provides for efficiently controlled handling of the ice block until it is reduced down to small remnants of ice. The original block of ice may be quite large, as much as 18 inches or longer in length. The final remnants of ice are small pellets, thus reducing ice waste. It is ideal to provide an even pressure to the block of ice as it is fed to the ice shaving machine.

The present invention thus relates to an ice shaving machine incorporating an ice block actuating and handling mechanism which is affixed to an ice shaving machine. The ice block actuator is positioned in the storage vault of the ice shaving machine, proper. The block of ice is fed into the vault and held until ice is required. When the ice cutting mechanism is turned on, the feed mechanism of the present invention is operated to slowly but firmly force the block of ice into a rotating ice shaving cutter mechanism. As the ice is cut, the shavings of ice shorten the block, but the block is continuously fed into the cutter. The device can be controlled quite readily by manual force that is applied by the operator personnel. The operator can thus view the shavings that are cut and spun off by the cutting mechanism and thereby control the rate of feed of the block of ice. The apparatus particularly employs a transverse bar adjacent to a guide rod. The transverse rod connects on the exterior of an ice vault with a hand operated lever. Upon rotation, the bar itself rotates a U-shaped eccentric. The eccentric urges a loosely fitted wobble plate around the guide rod in the direction of feeding the ice. The wobble plate is loose around the rod until urged by the U-shaped eccentric. As it is moved, it pulls a coil spring snugly around the guide rod. It then exerts a top and bottom binding press on the rod whereby a driving force is achieved. When the wobble plate is released by returning the eccentric to a vertical or neutral position, the wobble plate is pulled backwardly by the spring, and the wobble plate then relaxes its grip around the guide rod. By a suitable pumping motion applied to the lever, the guide rod is pushed incrementally to thereby drive the block of ice into the shaver mechanism proper.

BRIEF DESCRIPTION OF THE DRAWINGS

FIG. 1 is a perspective view showing an ice shaver mechanism with the ice feed improvement of the present disclosure;

FIG. 2 is a sectional view through the entire apparatus shown in FIG. 1 showing the position of the ice feed mechanism relative to the shaver mechanism;

FIG. 6 is an elevational view of an ice shaver having multiple ice shaving blades incorporated therein.

FIG. 7 is a sectional view of the ice shaver taken along line 7—7 of FIG. 6 and showing the structure thereof in detail;

DETAILED DESCRIPTION OF THE ILLUSTRATED EMBODIMENT

Figure 3:
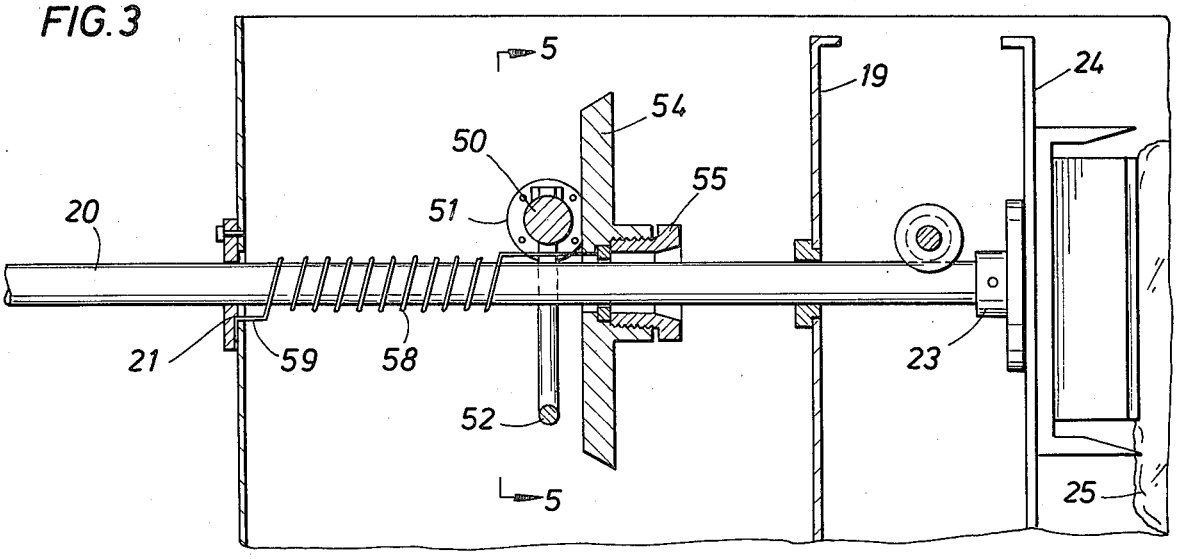
FIG. 3 is an enlarged, detailed view of the ice feed mechanism particularly illustrating the arrangement of an eccentric and wobble plate mechanism about a guide rod.

Attention is first directed to FIG. 1 of the drawings. In FIG. 1, the numeral 10 identifies an ice shaver mechanism, in general. The ice shaver mechanism is mounted on a suitable table 11 which supports a motor 12. The motor 12 drives the mechanism by means of a suitable flex belt drive, and the dotted line shown in FIG. 1 is a safety shield around the belt drive mechanism to protect personnel. The table 11 is generally flat on the top and includes a large ice receiving vault 14. The vault 14 is fabricated and assembled out of rustproof sheet material, such as stainless steel. The vault 14 may also be fabricated of plastic or plastic-like material having insulating qualities. The vault 14 incorporates a bottom 15 shown in FIG. 2. The bottom 15 defines the shape of the vault, which is primarily rectangular with upstanding walls around it. An end wall 16 is shown at the left side of FIG. 1 and is of greater height than any block of ice to be placed in the apparatus. Preferably, the block of ice is limited in height to a height that is readily accommodated by the shaver mechanism. The end wall 16 is preferably equal in height to side plates 17 and 18 shown in FIG. 1. The side plates are positioned in generally parallel relation to one another and have an outwardly protruding lip to guide a block of ice towards the center as it is placed on the top edge. There is also provided an intermediate wall 19, better shown in FIG. 2 which is a fixed wall positioned generally parallel to the wall 16, and which joins to the bottom plate 15 by means of suitable rivets or welds along the bottom edge. The walls 16 and 19 define guide apertures that align a push or guide rod 20 extending therethrough.

The rod 20 passes through a ring 21 which is fixedly attached to the end plate 16. The rod 20 is slidable through the ring 21. The ring 21 serves as a guide which permits the rod 20 to move axially, but which maintains it on a centerline axis. The guide plate 19 also supports a guide ring 22 which is similar in construction and functions as the guide ring 21. The guide rings provide alignment for the rod 20. The rod 20 thus extends through the two guide rings and terminates at a fixed collar 23. The collar 23 is held by a set screw or key and slot arrangement to the rod and is joined to a ram plate 24. The ram plate 24 is slidably positioned on the top side of the bottom plate 15. It has a width approximately equal to the spacing of the sidewalls 17 and 18, and may have a height substantially equaling the height of the end plate 16. The ram plate functions as a ram to drive a block of ice to the right, as viewed in the drawings. The ram plate is held substantially perpendicular to the rod 20. The rod 20 is thus permitted to advance to the right. Rotation is not necessary. The rod 20 and the plate 24 thus function together somewhat as a guide or ram mechanism to impart a driving force to a block of ice.

An exemplary block of ice is identified at 25 and is positioned between the side plates and adjacent to the ram plate 24. The ice block is forced to the right in FIG. 2 as the ram plate is moved to the right by its actuating mechanism. The motor 12 will be observed to drive a flexible belt 26 which passes over a pulley 27. The pulley rotates a shaft 28 which, in turn, passes through a fixed housing 30. The housing has a central shaft opening which is provided to receive the shaft 28, and the housing is anchored to the support table structure which provides support and stability for the mechanism. The housing 30, being fixed, receives a rotating cutter that is secured to the shaft 28 and supported by a bearing surrounding the shaft. The cutter structure will be described in detail hereinafter. The housing 30 is open on its entire left side towards the ice 25. It is not necessary to expose all of the cutter unless the block of ice is quite tall. Preferably, smaller blocks of ice are used, if for no other reason, to obtain a more easily handled weight for the operator. To this end, a gate 31 is shown in FIG. 2. The gate 31 slides upwardly and downwardly and is locked in position by a lock bolt 32. The bolt 32 clamps the gate 31 so that it defines a bottom gap through which the block of ice slides. The gate 31 stabilizes the block of ice and keeps it from vibrating as the forces of the cutter are applied to it during ice shaving operations. The gate counteracts rotational torque imparted to the block of ice by the spinning ice shaver head.

Attention is momentarily directed to FIGS. 1 and 2 of the drawings where the gate 31 is shown in position between the adjacent sidewalls 17 and 18. The gate is positionable to cover over part of the rotating ice shaver head. The gate 31 is formed at the upper portion thereof to define a spring-like resilient section **31*a* that is capable of flexing in response to upwardly directed forces that the gate may receive from the ice block 25. The plate material of gate 31 is reverse bent back upon itself a suitable number of times to define the resilient section. The lower portion of the gate is thus enabled to function as a follower and maintain contact with the upper portion of the ice block 25**.

Figure 8:
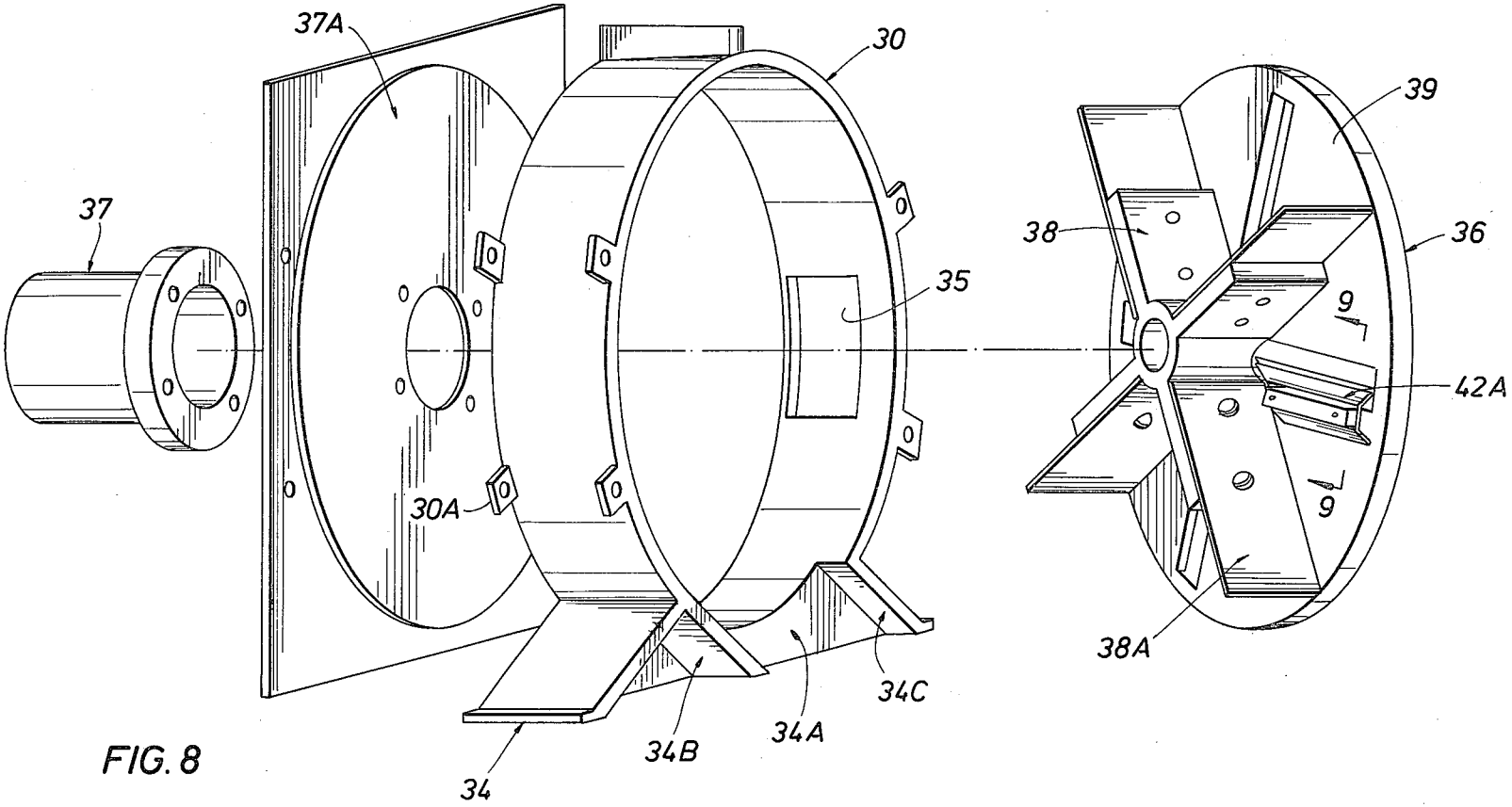
FIG. 8 is an exploded isometric view showing structure of the circular ice shaver in detail.

FIG. 1 further shows the housing 30 in broken line which is shown to surround the cutter head, as is evident from the showing of FIGS. 6 and 8. The housing defines bottom attachment elements which are integrally fabricated or cast with it and defines flanges 34 which may be suitably anchored to the table 11. In addition, the housing fully encircles the rotating cutter head at all points, except at a side ejection opening 35 about which is positioned a lateral, downwardly directed delivery chute **35*a* which extends to the side. Ice is cut and centrifugally thrown outwardly where it exits the housing through opening 35. It is ejected by the cutter head assembly into the chute and thrown outwardly through the opening 35 and into the delivery chute 35*a***.

The lower portion of the housing 30 is formed to define a recess **34*a* located between inclined walls 34*b* and 34*c*. Any coarse and therefore undesirable ice residue that remains between the vault 14 and housing 30 after an ice shaving operation has been completed will descend through an opening defined cooperatively by the walls 34*b* and 34*c* in cooperation with the face plate 39 of the cutter head assembly. The ice residue will flow from the opening into a removable receptacle 34*d*** that is retained beneath the upper portion of the table. Since this ice residue will be near freezing temperature, it is readily refrozen into blocks when deposited in a freezing receptacle of an ice block machine.

The cutter head proper is shown in FIGS. 6, 7 and 8 and is identified generally by the numeral 36. The cutter head is mounted on the shaft 28, previously described in FIGS. 2 and 7, at a central hub 37, shown in FIG. 8. The cutter head includes laterally projecting ribs 38 which give it structural integrity. Flexible rib extensions **38*a* are secured to the rib elements 38 by bolts or by any other suitable means of connection and rotate along with the cutter head. The rib extensions are composed of a yieldable plastic material which has sufficient structural integrity to contact shaved ice particles and induce centrifugal force thereto so that the ice particles are ejected through the opening 35 of housing 30. In the event operating personnel should place a finger or other object through the opening 35, the yieldable rib extensions will yield and refrain from inflicting any injury. Of course, the discharge chute 35***a* defines a safety element that prevents operating personnel from gaining access to the outlet opening 35, but the yieldable rib extensions provide a further safety feature for protection of the operating personnel. It also incorporates a face plate 39 which is fairly smooth and circular and is made rigid by the construction illustrated in the drawings in the preferred embodiment. The face plate 39 is smooth substantially across its entire extent except that it is formed to define a plurality of radial slots. It will be observed that the slots are all radial, except that there is a minor offset at the very center. The offset enables at least one of the cutter blades to extend to the center whereas perfect radial positioning would jam up the cutter blades at the center. It is more desirable that the cutter blades have the slight offset shown in FIG. 6 to cut over the entire face of the cutter.

Figure 9:
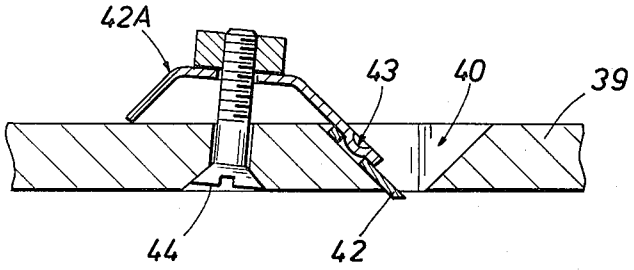
FIG. 9 is a fragmentary sectional view showing a clamp mechanism for an ice shaver blade which is replaceable upon release and a clamp mechanism for holding it in position.

Each radial slot is V-shaped, as shown at 40 in FIG. 9. A cutter blade formed fo flat tool steel is illustrated at 42 and is formed to define a sharp cutting edge which extends through the V-shaped slot and protrudes outwardly from the cutter head 36. The cutter blade is made of flat stock and is relatively thin, but is sufficiently thick to provide adequate stiffness in operation. Moreover, the cutter blade 42 is held in position by a clamp 42*a*. The blade has substantial length, ranging up to many centimeters, and is drilled or notched with suitable holes at spaced locations. A V-shaped clamp element 42*a* is positioned over it. A detent 43 is bent down into the spaced notch or hole formed in the cutter blade 42. The clamp element 42*a* is, in turn, fastened by suitable machine bolts 44 that extend through apertures formed in the face plate 39.

As is shown in FIG. 8, the clamp plate 42*a* is fastened at multiple locations along its length to give rigidity and fixed mounting to the cutter blade 42. For example, if the removable cutting blade 42 is fifteen centimeters in length, it is optimum to utilize a clamp plate 42*a* which is close to that length and supported by three or four bolts 44. This arrangement enables the blade 42 to be periodically removed and dressed. While it will wear, the wear will ordinarily be evenly distributed. Replacement of a blade 42 is conveniently accomplished by loosening the bolt 44 which, in turn, loosens the clamp plate 42*a* permitting removal of the blade 42. In this manner, the blade 42 may be removed from the front or smooth side of the face plate 39 without dismantling the entire cutter head assembly.

As further shown in FIG. 8, a plate 37*a* is adapted for assembly to the housing 30 and the ribs 38 and hub 37 are disposed in closely spaced relation with the plate 37*a*. A bushing or suitable bearing is adapted for interconnection with plate 37*a* by means of bolts or any other suitable form of attachment. The plate 37*a* includes a rectangular portion and a circular portion as shown. The circular portion is sized to be received within the housing 30 upon assembly of the plate 37*a* with the housing 30. Screws, bolts or the like may be used to mount the plate 37*a* to the housing 30. Holes are provided in the rectangular portion of the plate 37*a* and tabs 30*a* are provided on the housing 30 for receiving the connecting bolts (not shown in the drawings for the sake of clarity).

From the foregoing, it will be understood how cutting is achieved. The block of ice 25 is forced in controlled manner against the face plate 39. Rotation of the face plate 39 at a fairly high rate of speed carries the cutters against the block of ice, thereby shaving particles of ice from it, and these particles are consequently ejected by centrifugal force out through the opening 35 and through the chute 35*a* to be collected by the operator.

Figure 4:
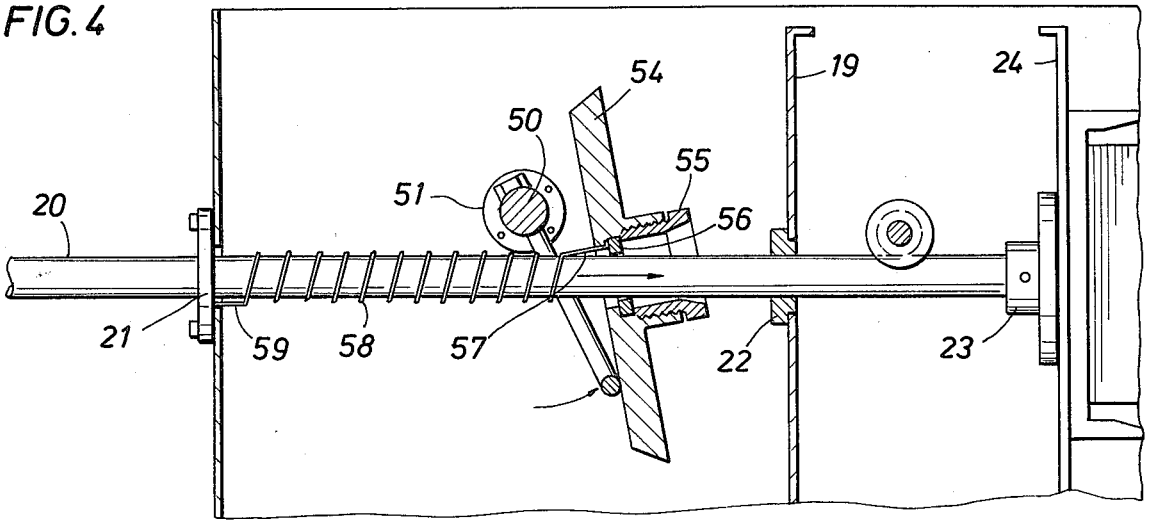
FIG. 4 is a view very similar to FIG. 3 showing relative movement of the components wherein the wobble plate has moved the guide rod to the right.
Figure 5:
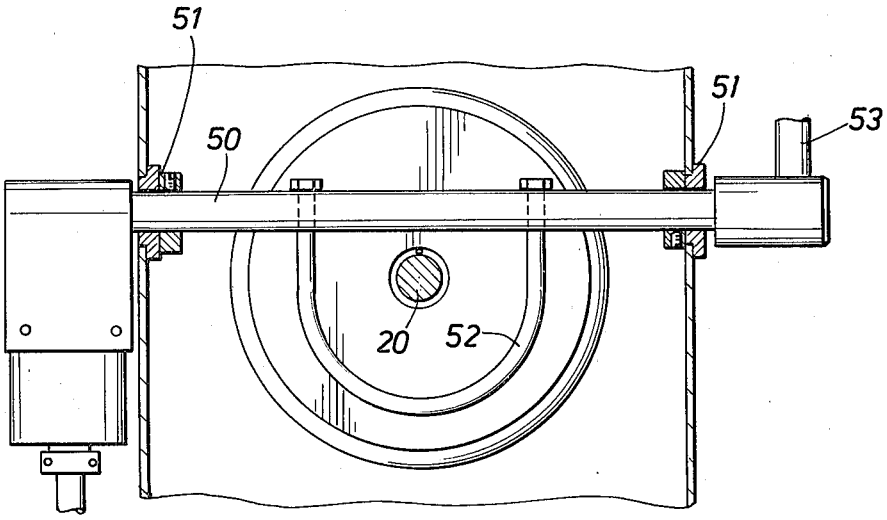
FIG. 5 is a sectional view taken along the line 5—5 of FIG. 3 showing details of construction of the wobble plate and eccentric mechanism for driving the wobble plate.

Attention is next directed to FIGS. 3, 4 and 5, jointly. There it will be observed that there is a transverse control shaft 50 which is rotated by an externally located handle 53. The shaft is supported between the sidewalls 17 and 18 by suitable mounting hubs 51 which are fixed to the walls so that the shaft is permitted to rotate. The shaft supports a downwardly projecting U-shaped eccentric mechanism 52 which is shown better in FIG. 5 of the drawings. The U-shaped eccentric actuator arm 52 is thus rotated about the shaft 50 when the external lever 53, shown in FIG. 5, is rotated. The eccentric 52 bears against a wobble plate 54 which is preferably in the form of a disk which is formed to define an enlarged axially oriented aperture to enable it to loosely fit around the push rod 20. Moreover, the wobble plate is equipped with internal threads to receive a retainer sleeve 55, the interior which is larger than the rod 20 and is chamfered at one end. The retainer fitting 55 is preferably used as a lock to secure a steel ring 56 in assembly with the wobble plate. The ring 56 has the capability to establish an enhanced frictional grip with the rod. As will be understood, the ring 56 is also positioned in loose relation around the rod so that it can slide. This loose position is particularly achieved when the wobble plate 54 is perpendicular to the rod 20. By contrast, the wobble plate 54 has a central opening, an opening which is slightly offset. As shown in FIG. 3, the ring 56 is thus elevated away or above the rod 20 at the top and bottom points of contact. In other words, it clears the rod and the wobble plate is thus free to slide in a metal-to-metal contact. The hole in the wobble plate is off center and enlarged on the lower part of the wobble plate. Therefore, the metal portion of the wobble plate does not come into contact at the lower point of the opening. The ring 56 is closer to the rod, as shown in FIG. 3.

When the wobble plate is canted, it brings the steel ring 56 into high frictional contact with the rod. As the control shaft 50 is rotated, and thereby rotates the eccentric 52 in the counterclockwise direction shown in FIG. 4, the wobble plate is first tilted or canted. This movement causes the steel ring 56 to bind against the rod 20. Continued rotation of shaft 50 drives the wobble plate to the right by virtue of moving the U-shaped member 52 and carries the rod 20 with it. Such movement is a result of the binding activity mentioned above, which is achieved on the canting on the wobble plate. There is no binding when the wobble plate is substantially perpendicular to the rod.

The wobble plate moves to the right when forced to the angular position of FIG. 4. It is connected to a pigtail 57 that defines one extremity of a long, multiturn helical spring 58 that is positioned about the shaft 20. The opposite end of the spring is defined by another pigtail shown at the lefthand end and identified by the numeral 59. The pigtail 59 is anchored in the fixed structure 21 as shown at FIG. 3 and is not free to move. The spring is made of multiple helical coils which, when relaxed, fit loosely around the rod. When the wobble plate, however, is pushed to the right, the spring is pulled tight against the rod. This occurs when the pigtail 57 is pulled. In other words, a pulling force on the pigtail 57 reduces the turns of the spring to a gripping diameter and then pulls the rod 20 to the right. The spring achieves a tighter grip near the wobble plate, not the opposite end, to enhance pulling to the right.

The spring and wobble plate thus combine to grip the rod 20 and push it to the right. As the rod is pushed to the right, it carries the ram plate 24 with it. This, in turn, pushes the block of ice 25 to the right which forces the ice against the rotating cutter head mechanism previously described. On retraction of the handle 53 to the beginning position, the eccentric member 52 retracts from the wobble plate which then returns to its generally upright position. The wobble plate is then pulled back by the spring 58, following the eccentric 52 as the spring force induces retraction movement. Retraction of the spring 58 is accompanied by enlargement of the helical coils of the spring, thus releasing the frictional grip of the spring relative to the rod 20, and the device returns to the beginning position of FIG. 3. Thus, the rod 20 is gripped periodically and forced to the right by incremental steps. Each incremental step is achieved on oscillatory movement applied to the rod 50 by handle 53. This control lever is thus provided for the benefit of the operator and is positioned at a convenient location for the operator. The operator is able to oscillate the external control lever 53 periodically to drive the block of ice to the right or into the shaver mechanism. As the incremental rod movement occurs, the ice is driven toward the cutter until it engages the cutter head and begins to be shaved away.

The device is reset by pushing by hand the ram plate 24 and the rod 20 back to the left. They are free to slide through the wobble plate and the spring. This resets the mechanism for its initial state, whereby subsequent operation moves it back to the right.

The present invention is particularly advantageous in that the operator has substantial leverage. A small force applied to the end of the arm 53 imparts adequate driving force to the block of ice. In addition, when rotating force is applied by the operator to the handle 53, it actuates a mercury switch encased in the transverse rod 50 on the end extending outwardly from the wall 18. The mercury switch allows electricity to be introduced to the motor providing a driving force to the cutter head via the pulley. The use of this novel apparatus enables the operator to properly apply force to the lever 53 and collect the shaved ice particles in a cup or other device, which requires both hands. When the handle 53 is released by the operator for discontinuance of the operation for safety reasons, the power is immediately ceased via the backward rotation of the mercury switch. The block of ice is self-lubricating on the bottom of the vault 14, and, hence, friction is held to a minimum. Accordingly, suitable force driving the block of ice into the cutter head is applied routinely.

As previously mentioned, the ice shaving machine disclosed herein may be fabricated of plastic-like material. Plastic is preferred because of the its insulating qualities, particularly in the area of the hub 37 which houses a number of bearings. Plastic does not transmit temperature as well as stainless steel, for example. Thus, by reducing the transmission of cold temperatures to the shaft bearings and resulting moisture buildup, bearing life is prolonged, and the shaft 28 may rotate more freely.

The present invention has been described in detail, but the scope thereof is determined by the claims which follow.

We claim:

1. A feed mechanism for an ice shaving apparatus which comprises:

(a) ram means for engaging a block of ice to be fed into an ice shaving apparatus;

(b) an elongate guide rod connected to said ram means;

(c) means for mounting said guide rod to move axially along a locus which moves said ram means toward and away from the ice shaving apparatus;

(d) means for incrementally advancing said guide rod to thereby advance said ram means;

(e) means for initially positioning said guide rod and said ram means to receive a block of ice between said ram means and the ice shaving apparatus; and means for releasably and controllably engaging said guide rod which includes;

(1) a loose coil spring about said guide rod;

(2) means for pulling said spring to a tight gripping condition;

(3) means relaxing said coil spring to a loose condition; and (4) means for anchoring one portion of said coil spring.

2. The apparatus of claim 1, including a generally open topped, sidewalled ice block vault adapted to receive therein a block of ice between said ram means and the ice shaving apparatus at one end of said vault.

3. The apparatus of claim 2, wherein said vault includes a fixed upstanding wall to guide said ram means in its movement.

4. The apparatus of claim 3, including a vertically slidable gate covering over a portion of the ice shaving apparatus and means for mounting said gate for vertical closing movement.

5. The apparatus of claim 4, including a surrounding housing and ice shaving outlet affixed to said housing adjacent to said ice shaving apparatus and further including a drive shaft received into said housing for driving the ice shaving apparatus to cut ice.

6. The apparatus of claim 1, including a handle powered means for operator control of said guide rod and ram means.

7. The apparatus of claim 6, including a pair of fixed and aligned mounting hubs for said handle powered means.

8. The apparatus of claim 7, including first and second bushings in opposing walls of an ice receiving vault.

9. A feed mechanism for an ice shaving apparatus which comprises:

(a) ram means for engaging a block of ice to be fed into an ice shaving apparatus;

(b) an elongate guide rod connected to said ram and (c) means for mounting said guide rod to move axially along a locus which moves said ram means toward and away from the ice shaving apparatus;

(d) a rod actuator member defining a rod passage through which said guide rod extends, said passage loosely receiving said guide rod;

(e) rod gripping means being interconnected with said rod actuator and defining an opening through which said guide rod is loosely received;

(f) actuator movement means being moveably connected to said ice receiving vault and adapted to impart canting movement to said rod actuator, said canting movement establishing a gripping relation between said rod actuator and said rod gripping means and facilitating incremental linear movement of said rod actuator and guide rod upon further movement of said actuator movement means to thereby advance said ram means; and (g) means for initially positioning said guide rod and said ram means to receive a block of ice between said ram means and the ice shaving apparatus.

10. The apparatus of claim 9, wherein said rod gripping means comprises:

friction gripping means being located within said rod passage, upon said canting movement of said rod actuator member said friction gripping means moving into gripping relation with said guide rod, said guide rod being moved in linear manner by force applied thereto by said rod actuator means.

11. The apparatus of claim 10, further comprising:

(a) an open topped, sidewalled ice block vault adapted to receive therein a block of ice between said ram means and the ice shaving apparatus at one end of said vault;

(b) a control shaft being rotatably interconnected with said vault;

(c) an actuator arm extending from said control shaft and adapted to engage said rod actuator member and cause canting of the same upon rotational movement of said control shaft; and (d) an external lever being connected to said control shaft externally of said vault and being manually manipulated to induce rotational movement to said control shaft.

12. The apparatus of claim 11, wherein said actuator arm comprises:

a U-shaped member being connected at each end thereof to said control shaft, a portion of said U-shaped member adapted to contact said rod actuator member at a location spaced from said rod passage.

13. The apparatus of claim 12, wherein:

said rod actuator member is a generally plate-like structure having a centrally oriented hub, said rod passage being formed within said hub.

14. The apparatus of claim 13, wherein said rod actuator member includes:

a retainer member being received in connection with said hub, said friction gripping means being retained within said rod passage by said retainer member.

15. The apparatus of claim 9, including:

means urging said rod actuator member in a direction opposing ice advancing movement of said guide rod.

16. The apparatus of claim 15, wherein said urging means comprises:

a tension spring being interconnected with said vault and with said rod actuator member.

17. The apparatus of claim 16, wherein:

said spring is a helical spring disposed about said guide rod, said helical spring gripping said guide rod upon being extended by rod advancing movement of said actuator member.

* * * * *